United States Patent [19]
Wirtgen
[11] 4,317,642
[45] Mar. 2, 1982

[54] METHOD AND APPARATUS FOR ABRADING AND RECOATING ROAD PAVEMENTS

[76] Inventor: Reinhard Wirtgen, Hohner Strasse, 5461 Windhagen, Linz, Fed. Rep. of Germany

[21] Appl. No.: 95,611

[22] Filed: Nov. 19, 1979

[30] Foreign Application Priority Data

Nov. 20, 1978 [DE] Fed. Rep. of Germany ..... 2850344

[51] Int. Cl.[3] ..... E01C 3/06
[52] U.S. Cl. ..... 404/72; 404/91
[58] Field of Search ..... 404/91, 92, 102, 90, 404/83, 95, 72

[56] References Cited

U.S. PATENT DOCUMENTS

| | | | |
|---|---|---|---|
| 1,938,755 | 12/1933 | Swearingen | 404/91 |
| 2,069,376 | 2/1937 | Madsen | 404/92 |
| 2,211,262 | 8/1940 | Flynn | 404/91 |
| 2,394,017 | 2/1946 | Seaman | 404/91 X |
| 2,413,908 | 1/1947 | Chester | 404/92 |
| 2,747,475 | 5/1956 | West | 404/91 |
| 2,783,698 | 3/1957 | Bambi | 404/91 X |
| 3,843,274 | 10/1974 | Gutman | 404/91 |
| 3,893,780 | 7/1975 | Gutman | 404/91 |
| 4,011,023 | 3/1977 | Cutler | 404/91 |

*Primary Examiner*—Nile C. Byers, Jr.
*Attorney, Agent, or Firm*—Steinberg & Raskin

[57] ABSTRACT

The invention relates to a method and apparatus for abrading and recoating road pavements by peeling or milling the road pavement surface which is to be renewed and coating it again, wherein the milled-off material is collected, heated, if desired, and mixed with aggregates, and is then applied as a new pavement. The apparatus for performing this method comprises a peeling or milling unit provided on a chassis, which is preferably automotive, a collector device for the peeled-off or milled-off material and, if desired, an additional road paver for the application of the new road pavement material, wherein in addition to said collector device a mixer is provided, in which the peeled-off or milled-off material may be mixed with the ingredients which are to be used for the renewed application.

23 Claims, 4 Drawing Figures

METHOD AND APPARATUS FOR ABRADING AND RECOATING ROAD PAVEMENTS

The invention relates to a method for abrading and recoating road pavements by peeling or milling the road pavement surface which is to be renewed and coating it again.

For the repair of road damage, particularly such damage as caused by spiked tires, various methods have been developed.

For mending roads in the area of the grooves, the bituminous road pavement is milled by means of milling machines to the necessary depth and the milled out range is mended by applying fresh bituminous road pavement material.

Such a measure however constitutes only a provisional repair of the damage.

In accordance with another method, the surface of the bituminous road surface is milled by a milling machine having a width up to 4 meters to the desired depth, the milled-off material is transported by trucks to dumping sites, and subsequently a new road surface of bituminous road pavement material is applied in the hitherto known manner.

In addition to the fact that by this procedure valuable raw materials are lost and have to be transported by rather expensive means to dumping sites, this method has furtheron the disadvantage that it is very time consuming and thus the traffic is obstructed for a certain length of time by the construction site and by the traffic associated with the removal of the milled-off material and the oncoming transport of the new material. The deposition of the milled-off bituminous material on the dumping sites causes furtheron increasing problems with a view to the pollution of the environment.

In accordance with the prior art asphalt pavement regeneration method, the old bituminous pavement is heated, in a first working step, and the heated layer is then ripped off by a pavement breaker. Immediately behind the breaking teeth, the loosened material is uniformly distributed over the treated road pavement by means of a distributor device and is then pre-compressed. In a subsequent working step, an additional covering pavement of new material is applied by means of a common road surfacing machine.

Although in this method the costly removal of the milled-off material is eliminated, this method may because the old bituminous mixed material has to be used again in an unchanged composition be employed only in such cases where the old existing road pavement corresponds, in the material composition thereof, to modern requirements. This is however the case only in very seldom instances so that the application of this method as well as the repaving method developed therefrom, where the above mentioned working steps of heating, milling, distributing, compressing, and in some cases also coating with a new road surface material is applied, is restricted only to individual cases, because the old road surface material includes, as a rule, such compositions, which no longer meet the requirements of modern road traffic.

It is now the aim of the present invention to provide a method of the kind mentioned hereinabove, which may be widely employed in all common road pavements, independently from the composition thereof, and wherein the repair is made in few steps, preferably in a single working step, while the milled-off old road pavement material is widely used again so that the extensive transporting problems are eliminated and the road traffic is obstructed to a small extent and for a short period only by the repair works.

The problem of the invention is solved by a method for abrading and recoating road pavements by peeling or milling the road pavement surface, which is to be renewed, and coating it again, which is characterized in that the milled-off material is collected, heated, if desired, and mixed with aggregates, and is then applied as the new pavement.

The removal of the old pavement layer to the required depth may be performed by milling or peeling, while suitably heating the road surface pavement prior to this step in order to plastify it and so to simplify the removal, and particularly reduce the wear of the milling and peeling devices.

The peeling of the old road surface pavement has shown to be more advantageous for the method of the invention as in this case grain desintegration, common in milling, caused by the crushing of the mineralic constituents is not experienced so that the structural composition of the peeled-off material, as far as binders and mineralic constituents are concerned, will remain widely unchanged by the peeling process.

By the method of the invention, the composition of the milled-off road pavement material may be varied within wide limits by the admixture of aggregates.

In accordance with an advantageous embodiment of the method of the invention, the peeled-off and collected material is mixed with such aggregates, which are missing in the desired new road pavement and is then applied as the new pavement.

Although in many cases, the outer shape of the old road pavement will reveal the composition thereof and the missing component (binder or mineralic constituent) may be admixed by the method of the invention, an improvement of the material to be applied again is in many cases not up to the standards of modern road construction.

Particularly in order to obtain highly wear resistant and highly strained road pavements especially in the construction of highways, it is necessary that very tight tolerances relative to the binder as well as to the grain composition of the mineralic constituents be observed.

These requirements are met by a particularly advantageous embodiment of the method of the invention, which is characterized in that prior to the milling, the composition of the road pavement, which is to be renewed, is determined by sampling and to analysing, and the peeled and collected road pavement material is then added the missing components and is then employed as the new pavement.

While making practically complete use of the milled material, new road pavements may be obtained by this method of the invention, which do not differ in their properties from road pavements produced from completely new coating material.

If the road pavement surface is heated before it is peeled, the peeled-off material is obtained in a heated state. If on the other hand peeling is done without heating, the milled-off material is of ambient temperature.

In accordance with the present invention, it has shown to be of advantage if the milled material is mixed with the aggregates in a heated state. Consequently and in accordance with a further advantageous embodiment of the present invention, the milled-off material may be heated prior to, or during, mixing and is then applied as the new road pavement in a heated state. The collected material which if desired may be reheated is therefore supplied to a mixer provided on the chassis of the milling machine and is mixed therein together with the aggregates required for the desired new road pavement and is then, in the heated state, applied as the new road surface by a common building machine (road paver) which is either directly connected to the milling machine or follows it as a separate unit.

In accordance with a further advantageous embodiment of the method of the invention, the milled road pavement is subjected, prior to the application of the reprocessed material, to a heating process. It has shown that the adhesion of the material applied to the milled road pavement is substantially improved by such a heating step.

Heating of the milled road surface prior to the application of the new pavement may suitably be effected by gas jets common for this purpose.

The advantages of the method of the invention result from the fact that road pavements having an arbitrarily composed bituminous coating layer may be milled off, and after variation and adaptation of the composition of the mixture of the milled material to the requirements of modern road construction may be reused as the new mixed material for the production of the new road pavement layer. It is therefore possible to compensate for either missing or excessive binder quantities, minerals etc in the milled-off material and to so influence the composition of the mixed material that a mixed material is obtained, which corresponds to the newest standards in road construction. The repaving process so far applied in very specialised cases only may thus be applied in a broad scope in the form modified according to the invention and makes a rapid repair of the damaged road pavement possible while valuable raw materials may be reused and the flowing traffic is obstructed only to a minor extent by the repair works.

The present invention relates furtheron to an apparatus for performing the method of the invention for abrading and recoating road pavements comprising a peeling or milling unit provided on a chassis, which is preferably automotive, a collector device for the peeled or milled material and, if desired, an additional road paver for the application of the new road pavement material. The apparatus of the invention is characterized in that in addition to the collecting device for the milled-off material, a mixer is provided, in which the peeled-off or milled-off material may be mixed with aggregates, which are to be used in the renewed application.

Such an apparatus may include a pre-arranged heating device for heated milling or heated peeling, which may comprise the common heated gas jets.

In accordance with a further advantageous embodiment of the apparatus of the invention, one or a plurality of storage bins for the aggregates and a subsequent dosing and transporting device to the mixer is provided. Such a storage bin makes possible the continuous admixture of the required aggregates while no second vehicle going alongside will block the second track.

In accordance with a further embodiment of the present invention, it has shown to be of advantage if the dosing and transporting device includes an adjustable discharge opening on the storage bin and a conveyor belt of variable speed by which the aggregate may continuously be supplied to the mixer.

It has shown to be particularly advantageous if the speed of the conveyor belt may be controlled by the advance speed of the machine. This may for instance be obtained in that the conveyor belt is driven via a correspondingly shaped drive shaft, if necessary by inserting a corresponding reduction gear or a controlled gear, directly by one of the chassis wheels. In this way, the quantity of the aggregate, determined as to the composition thereof in accordance with the analysis as performed, may rather simply, but rather exactly, be dosed, considering that the quantity of the milled-off material as taken over the total width of the milled road is relatively exactly proportional to the milled distance.

Variations of the milling depth effected in the course of the milling operation may easily be compensated for via the controlled gear and the speed changed thereby of the conveyor belt.

In accordance with an advantageous embodiment of the present invention, the collector device for the milled-off material comprises two V-shaped sheet-metal guides leading into the mixer opening. The material is transported by these guide sheets from the two sides of the milled off surface to the middle and thus arrives directly to the mixer, which, if desired may be provided with a particular conveyor device.

In accordance with a further advantageous embodiment of the present invention, the collector device comprises two contra-rotating worm conveyor screws arranged at right angles relative to the direction of travel, each of which covering suitably half of the milled road surface and depositing the milled-off material also in the middle.

In accordance with another advantageous embodiment of the present invention, the collector device comprises a worm conveyor screw arranged at right angles relative to the direction of travel including two contra-rotating worm halves. By such an embodiment, the same purpose is obtained, i.e. the material is collected in the middle where it may easily be taken up by the mixer.

As in the employment of worm conveyor screws for the removal of the milled-off or peeled-off material the fine-grained particles are not removed as a rule and remain on the otherwise cleaned road surface, there are provided, as in accordance with a further advantageous embodiment of the apparatus of the invention, following the worm conveyor screw(s), one, or two, respectively, worm brooms. They include suitably helically arranged brooms, which transport the fine-grained material to the middle so that it may also be mixed with the aggregates in the mixer and may be applied again. Such a collection of the fine-grained milled-off material is very advantageous for the later adhesion of the newly applied material.

In accordance with a further advantageous embodiment of the apparatus of the invention, the collector device for the milled material comprises a vacuum cleaner covering the total width of the milled or peeled road by which the total milled-off or peeled-off material inclusive of the fine-grained material is sucked off and is suitably transported directly to the mixer.

It is obvious that instead of one vacuum cleaner covering the total width of the milled area two vacuum cleaners each covering half of the area may be employed.

Mixing of the milled-off material with the aggregates is performed, as has been mentioned above, under the application of heat. Even if the road surface had been heated prior to the milling or peeling, and the milled-off material is obtained in a relatively hot state and is directly supplied to the mixer in this form, it has shown to be particularly advantageous in accordance with a further embodiment of the present invention, if an additional heating device for the milled-off material is provided by which the latter is heated to a constant temperature for the mixing process. In this case, an optimum mixture of the milled-off material with the aggregates is obtained and the mixed material newly to be applied is obtained in the hot form usually required for the application by which the required plasticity is obtained and the good adhesion to the milled road surface is achieved.

In accordance with another advantageous embodiment of the present invention, the mixer itself is provided with a heating device for the material to be mixed.

As the mixer for the milled-off road pavement material and the aggregates, any types of mixers may be employed. It has however shown to be particularly advantageous if the mixer is a forced mixer including two contra rotating mixer vane rollers.

On the other hand of course, a common drum mixer (mixing drum rotating around a horizontal axis) may be employed as well.

In the latter embodiment however, the charging with the material collected on the road pavement surface is not so simple, as the charging is effected from the upper edge of the drum, and the material has to be transported by a conveyor device from the road pavement into the drum.

In the above mentioned forced mixer, the mixer opening may be provided directly on the milled road pavement and the milled-off material may be lifted via a corresponding pushing sheet in the course of the forward movement of the apparatus and may directly be charged into the mixer.

For the aggregates, there is provided on the upper edge of the mixer a further charging opening suitably shaped as a funnel tube.

In accordance with a further advantageous embodiment of the present invention, the mixer is provided below the chassis and includes a charging opening open in the travelling direction and includes a bottom open to the road pavement. This means that the material remains directly on the road surface and is caught by the mixer vanes and is mixed with the aggregates. The mixer housing prevents only the materials to be mixed from emerging on the sides.

As the adhesion between the newly applied pavement layer and the milled-off road surface is better if the milled-off road surface has an increased temperature, too, a heating device is provided, in accordance with a further advantageous embodiment of the present invention, to heat the milled or peeled road pavement prior to the application of the new pavement.

The heating device comprises suitably such gas jets as are commonly employed for such purposes.

The material prepared in the mixer and ready to be applied may be applied as the new road pavement by a following road building machine (common road paver). In accordance with a particularly advantageous embodiment of the present invention, the road paver for the milled-off material is directly provided on the chassis behind the mixer.

The apparatus according to the invention renders therefore peeling, collecting, admixing of the aggregates and the ready application of the new road pavement possible in one working process so that a continuous work flow is warranted and the renewal of the damaged road pavement surface is made possible while obstruction of the flowing traffic is at a minimum.

Particularly in cases when the forced mixer referred to above is employed as the mixer which mixes the milled-off material together with the aggregates directly on the road surface, it has shown to be suitable to provide, in front of the grader device provided at the end of the chassis, a grader worm which uniformly distributes the material mixed with the aggregates for application over the road surface.

The invention will now be described in further detail based on the drawings, in which FIG. 1 is a side view of an apparatus according to the invention for milling and recoating road pavements.

Figure 1:
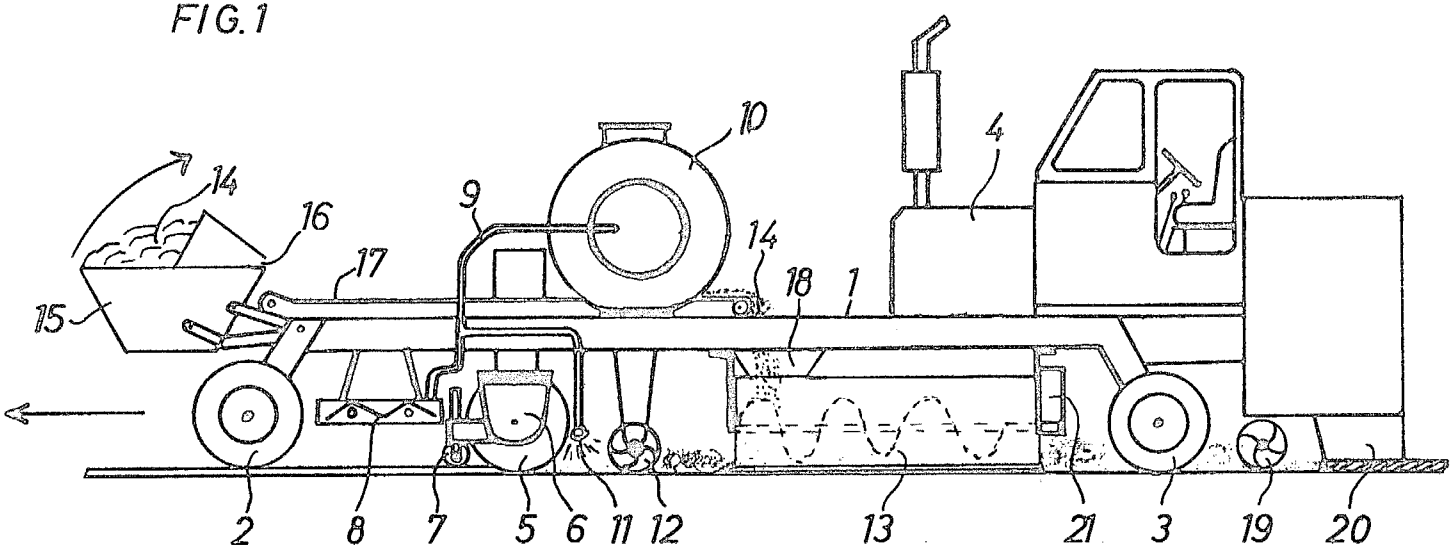

The apparatus for milling and recoating road pavements shown in FIG. 1 comprises a chassis 1 including a steerable front wheel pair 2 and a rear wheel pair 3 driven by a motor 4.

A milling roller 5, provided with jackwheels 7 at the two lateral holders 6 is vertically adjustably secured to chassis 1. A heating device 8 is similarly vertically adjustably arranged on chassis 1 in front of the milling roller 5, as seen in the travelling direction, and is supplied, via duct 9, with liquid gas from storage container 10. Behind the milling roller 5, as seen in the travelling direction, a second heating device 11 is provided, which is also supplied with liquid gas from container 10. This heating device serves for the further heating of the material milled-off by milling roller 5, which precipitates behind milling roller 5 and is deposited by worm conveyor screw 12, which comprises two contra-rotating worm halves, in the middle of the milled-off road surface.

The milled-off material so deposited is taken up by the mixer 13 provided on chassis 1 and is mixed in this mixer 13 together with the aggregate necessary for the preparation of the desired road pavement material. This aggregate 14 is dumped, from a truck, into tiltable storage bin 15 which is then hydraulically tilted so that the aggregate 14 travels via the adjustable discharge opening 16 onto conveyor belt 17 and from there through funnel shaped opening 18 into the mixer 13.

After intimate mixing together with the aggregate 14, the milled-off material leaves mixer 13 and is uniformly distributed by grader worm 19 over the milled road surface and is applied by means of surfacing device 20 (road paver) as the new road pavement.

Operation of the mixer vanes employed in the mixer is brought about via two fluid motors 21 provided at the rear end of the mixer.

Figure 2:
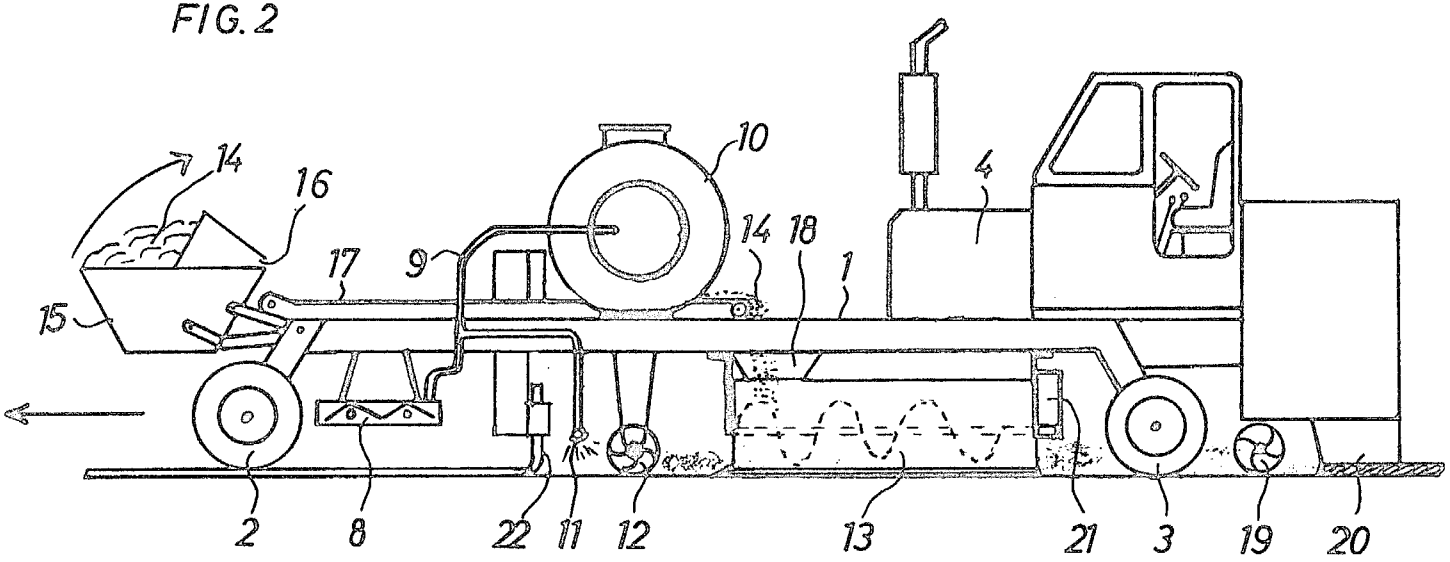
FIG. 2 is an apparatus according to the invention for peeling and recoating road pavements.

The embodiment of the present invention shown in FIG. 2 refers to an apparatus for peeling and recoating road pavements. With the exception of peeling apparatus 22, which comprises vertically adjustable peeling cutters, which peel the road pavement to be milled to a predetermined depth, this apparatus according to FIG. 2 corresponds, as relates to the other details of the embodiment, completely to FIG. 1 described above.

Figure 3:
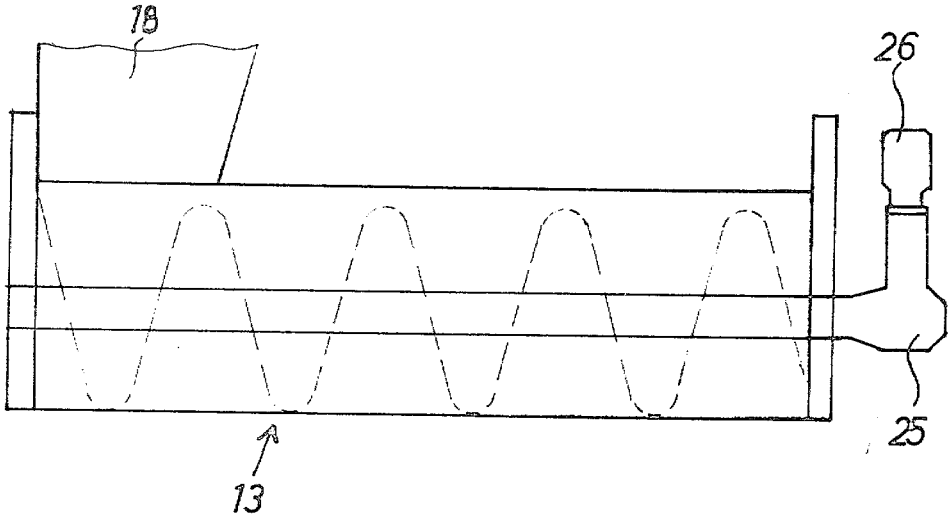
FIG. 3 is a schematic side view of the mixer employed in the apparatus according to the invention.

In FIG. 3, mixer 13 is shown in an enlarged representation. At the left end thereof, charge funnel 18 for the aggregate is provided while at the right end thereof, the mixer vanes are driven by a fluid motor 26 each, operated via a miter gear 25.

Figure 4:
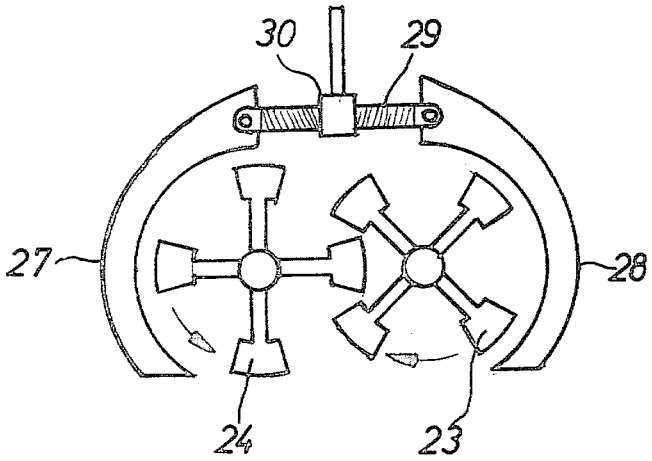
FIG. 4 is a front view in cross section of the mixer as employed in the apparatus according to the invention.

In FIG. 4, a particular embodiment of the mixer is shown in cross section. The two mixer vanes 23 and 24 are arranged in a housing open to the road pavement. The milled-off material collected by worm conveyor screw 12 arrives automatically in the reaction range of the two mixer vanes 23 and 24 and is intimately mixed together with the aggregate introduced via funnel 18 and is subsequently, after leaving mixer 13, uniformly distributed by the grader worm over the milled road surface.

The side walls 27 and 28 of the mixer housing may be adjusted in distance relative to each other by means of worm gear spindle 29 having right-hand and left-hand threads, respectively, and the corresponding adjusting screw 30.

In this way, the mixing intensity of the mixer may be varied.

I claim:

1. A method for abrading and recoating road pavements, comprising the steps of:

determining the composition of the road pavement material which is to be renewed by sampling and analyzing the same;

peeling or milling the road pavement material which is to be renewed from the road;

collecting the peeled or milled road material and heating the same if desired;

mixing the collected material with additional aggregate components of a type and in an amount determined by the composition of the road pavement material to be renewed; and applying the collected material and components mixed therewith to the road as a new pavement.

2. A method according to claim 1, wherein the peeled-off, collected and, if necessary, newly heated material is fed into a mixer provided on the chassis and is mixed therein with the aggregates which are missing in the desired new road pavement and is then by means of a road paver applied as the new pavement.

3. A method according to claim 1, wherein prior to the application of the new material the milled road pavement is subjected to a heat treatment.

4. A method according to claim 3, wherein said milled road pavement is subjected, prior to the application, to a heat treatment by gas jets.

5. Apparatus for abrading and recoating road pavements, comprising:

an automotive chassis;

means mounted on said chassis for peeling or milling the road pavement material which is to be renewed from the road;

means mounted on the chassis for collecting the peeled or milled road material;

at least one storage bin mounted on the chassis for storing aggregate components adapted to be mixed with the collected road material;

means mounted on the chassis for mixing the collected peeled or milled road material with the aggregate components;

means mounted on the chassis for conveying the aggregate components to said mixing means; and means mounted on the chassis for controllably dosing a suitable amount of the aggregate components onto said conveying means.

6. The combination of claim 5 wherein said dosing means comprises an adjustable discharge opening formed in said storage bin.

7. The combination of claim 6 wherein said means for conveying the aggregate components to said mixing means comprises a variable speed conveyor belt.

8. An apparatus according to claim 7, wherein the speed of said conveyor belt is controlled by the advance speed of said milling or peeling apparatus.

9. The combination of claim 5 wherein said mixing means comprises a mixing drum mounted for rotation about a substantially horizontal axis.

10. An apparatus according to claim 5 wherein said collecting means comprises two V-shaped sheet-metal guides leading into the mixing means.

11. An apparatus according to claim 5 wherein said collecting means comprises two contra-rotating worm conveyor screws arranged at right angles relative to the direction of travel.

12. An apparatus according to claim 11 wherein following said worm conveyor screw at least one worm broom is provided.

13. An apparatus according to claim 5 wherein said collecting means comprises a worm conveyor screw arranged at right angles relative to the direction of travel including two contra-rotating worm halves.

14. An apparatus according to claim 5 wherein said collecting means comprises a vacuum cleaner covering the total width of the milled or peeled road.

15. An apparatus according to claim 5 wherein a heating device for the milled-off material is provided.

16. An apparatus according to claim 15, wherein said mixing means is provided with a heating device for the material to be mixed.

17. An apparatus according to claim 5 wherein said mixing means constitutes a forced mixer including two contra-rotating mixer vane rollers.

18. An apparatus according to claim 17, wherein said mixing means is arranged below said chassis and includes a charging opening open in the travelling direction.

19. An apparatus according to claim 18, wherein said mixing means includes a bottom open to the road pavement.

20. An apparatus according to claim 5 wherein a heating device to heat the milled or peeled road pavement prior to the application of the new pavement is provided.

21. An apparatus according to claim 20, wherein said heating device comprises gas jets.

22. An apparatus according to claim 5 wherein behind said mixing means on said chassis a road paver device for the milled-off material is provided.

23. An apparatus according to claim 5 wherein in front of said road paver device a grader worm is provided.

* * * * *